United States Patent [19]

Hammersmith

[11] 4,072,789

[45] Feb. 7, 1978

[54] SHEET MATERIAL

[75] Inventor: James R. Hammersmith, Jeffersonville, Ind.

[73] Assignee: Brown & Williamson Tobacco Corporation, Louisville, Ky.

[21] Appl. No.: 308,116

[22] Filed: Nov. 20, 1972

[51] Int. Cl.[2] ..... A24C 5/48

[52] U.S. Cl. ..... 428/195; 428/211; 428/304

[58] Field of Search ..... 117/122 P, 122 H, 144, 117/168, 161 UF; 131/12, 10.3, 10, 10.5, 261, 210

[56] References Cited

U.S. PATENT DOCUMENTS

| | | | |
|---|---|---|---|
| 1,756,919 | 4/1930 | Becker et al. | 117/122 |
| 2,154,943 | 4/1939 | King | 117/44 |
| 2,348,688 | 5/1944 | Abrams et al. | 117/122 |
| 2,357,100 | 8/1944 | Gebauer-Fuelnegg et al. | 117/122 |
| 2,376,778 | 5/1945 | Kallander | 117/122 |
| 2,785,681 | 3/1957 | Fessler | 131/261 |
| 2,832,351 | 4/1958 | Hale | 131/9 |
| 3,298,851 | 1/1967 | Fuchs | 117/168 X |
| 3,349,749 | 10/1967 | Utschig | 117/38 X |
| 3,632,384 | 1/1972 | Saint-Pastou | 117/44 |

*Primary Examiner*—Bernard D. Pianalto
*Attorney, Agent, or Firm*—William J. Mason

[57] ABSTRACT

A predetermined pattern of impervious material is deposited on a sheet of coarse, self-cohesive filter material. The impervious material is fusible and adapted to be bonded to the filter material. The pattern of impervious material is such that when the sheet material is coiled into a filter rod and fused at least one antispin band will be formed in the rod located such that there are no interconnecting cavities between the coiled layers of sheet material. Additionally, at least one annulet plug will be formed in the rod and at least one disc plug will be formed in the rod. The outer diameter of the disc is at least as great as the inner diameter of the annulet to thereby provide a tortuous filter path for high efficiency and low pressure drop filtering procedures.

6 Claims, 14 Drawing Figures

FIG. 8
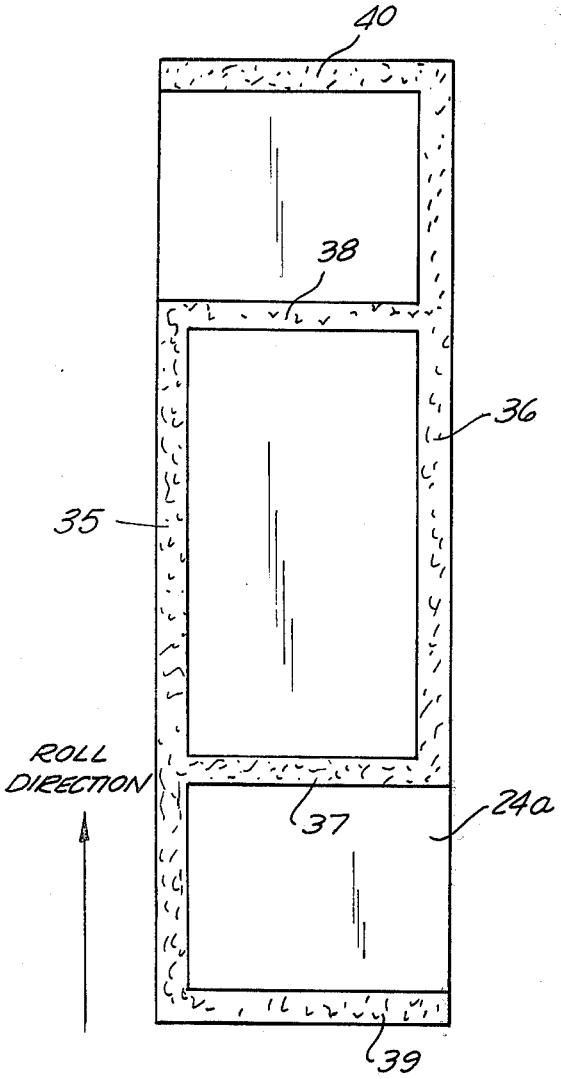
FIG. 10
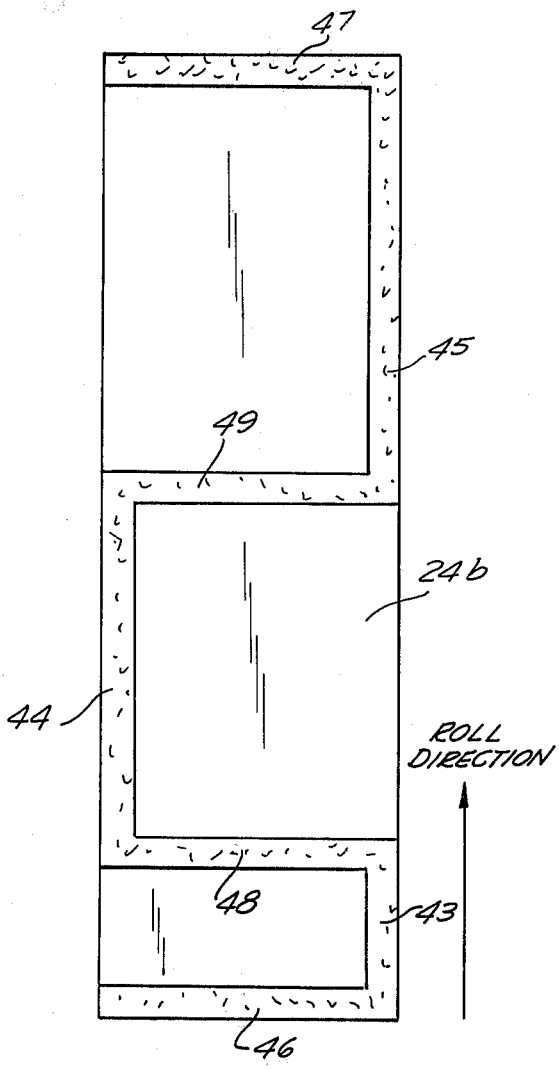
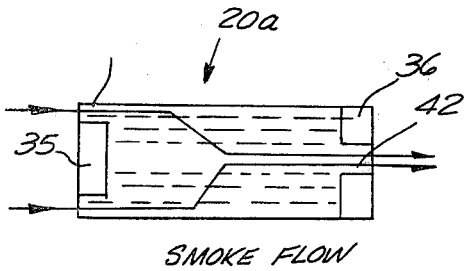
FIG. 9
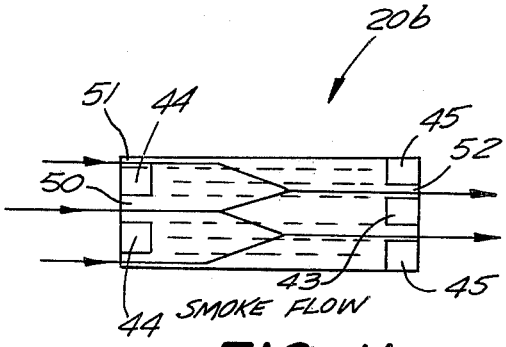
FIG. 11

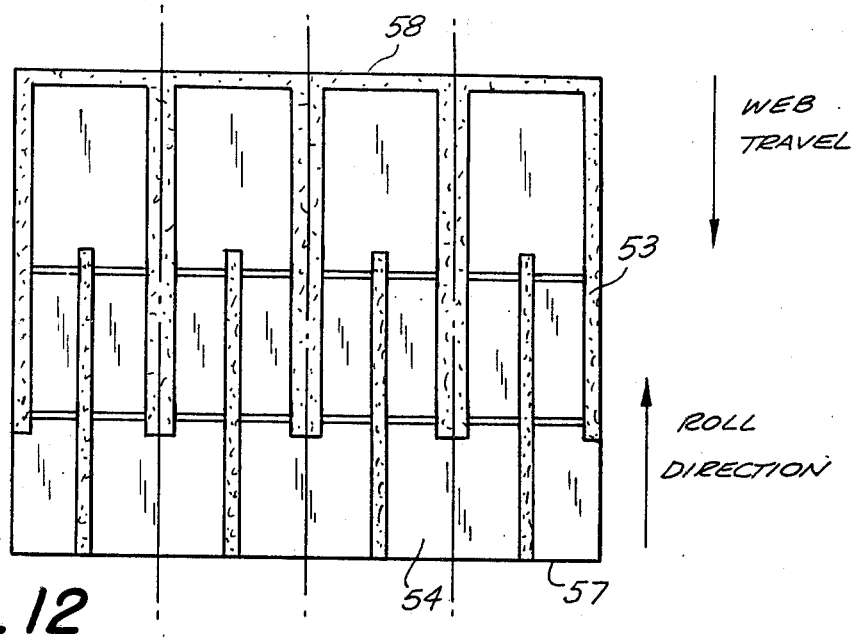
FIG. 12
FIG. 13
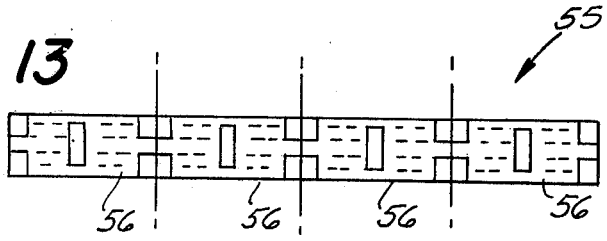
FIG. 14
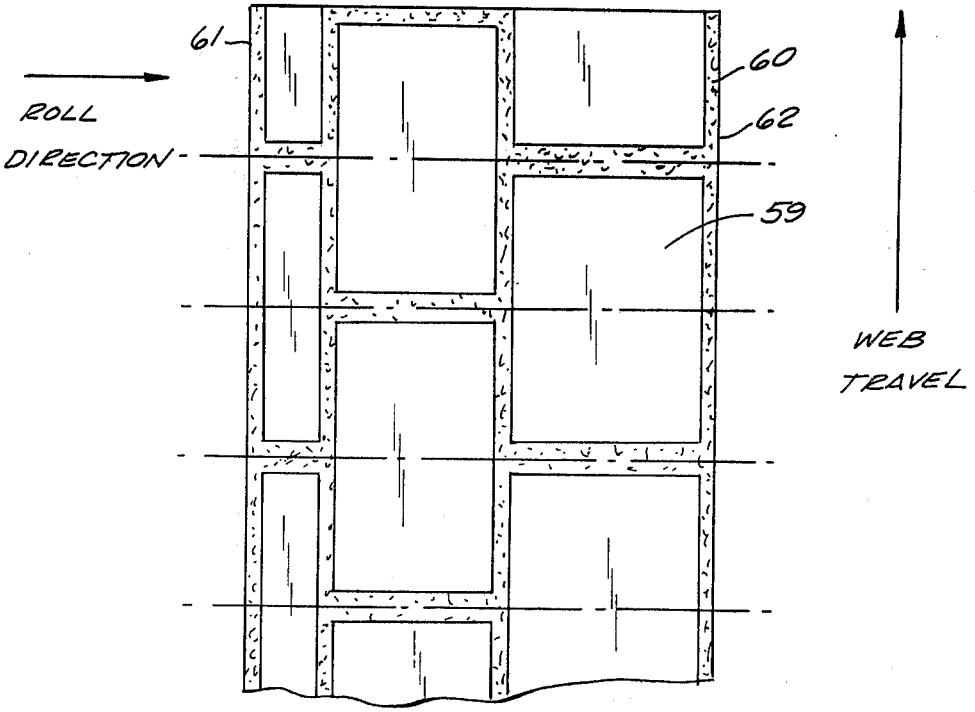

SHEET MATERIAL

BACKGROUND OF THE INVENTION

In the art of filter making, it is highly desirable to provide high efficiency and often low pressure drop filter. This is particularly an advantage in connection with cigarette filters. Many filtering procedures have been employed in an attempt to direct and control the flow of smoke from the tobacco through the filter to the smoker wherein the filtering process is highly efficient without significatnly increasing the pressure differential across the filter.

Naturally, the filter rod assembly for use in meeting the above discussed criteria should be of simplified manufacture with as few component parts as possible. In this manner, a filter of the lowest possible cost and ease of handling and use can be employed. In fact, it would be extremely desirable to have a single piece of material which provides both the internal filtering structure and the external support structure.

Filters of the type of primary concern in the application are collectively known in the art as "pass" type filters. The majority of these filters generally depend upon inserting one preformed tube into another tube and providing a tortuous flow path for smoke therethrough. As stated above, it must be kept in mind that the tortuous flow path must be sufficient to provide high efficiency type filtering while generally reducing the pressure drop in connection with the smoke flow on both sides of the filter.

SUMMARY OF THE INVENTION

With the above subject matter in mind, it is among the objectives of the present invention to provide new designs for directed flow type filters, particularly cigarette filters. The present designs provide high efficiency and low pressure drop filters and also provide for simplified filter rod assembly from a single piece of material. The single piece of material provides both the internal filtering structure and the external supporting structure.

The general filter designs shown and described herein are sealed rods of coiled sheet materials. The rods have internally positioned impervious discs and annuli of a fusible material which holds the rod together, space apart the coiled layers of sheet, and direct smoke flow across these layers.

All of the depicted and described embodiments contain at least one antispin band connecting a disc and annulet. These bands of impervious material separate one cavity layer from another cavity layer and create what is effectively a series of nestled porous tube-like structures. The disc or discs block one end of the inner axial cavity layers leaving the outer peripheral cavity layers of the same end open. The annulet or annuli leave the axial layers open while blocking the peripheral layers. With a correctly chosen pattern of antispin bands interconnecting alternate discs and annuli deposited or imprinted on a single sheet of filter material, one may make what is effectively a multitube multipass filter.

In summary, a filter rod is provided which may be formed from a single sheet of material adapted to be coiled. The sheet of filter material is of a porous, self-cohesive nature and has a predetermined pattern of impervious material deposited thereon. The impervious material is fusible and adapted to be bonded to the filter material. The pattern of impervious material is such that when the sheet material is spirally wound into a filter rod and fused at least one antispin band will be formed in the rod located such that there are no interconnecting cavities between the coiled layers of sheet material, at least one annulet plug will be formed in the rod, and at least one disc plug will be formed in the rod with the outer diameter of the disc being at least as great as the inner diameter of the annulet to thereby provide a tortuous flow path for high efficiency and low pressure drop filtering procedures.

The rod is formed by the process of cutting and rolling a predetermined size sheet of filter material having a predetermined pattern of fusible material deposited thereon so as to form a tube. The rolled tube is then constrained in shape while the material deposited on the filter is fused together to form at least one antispin band separating one cavity layer from another cavity layer and connecting at least one disc blocking one end of the inner axial cavity layers and leaving the other peripheral cavity layers open and at least one annulet blocking the outer peripheral cavity layers while leaving the inner axial cavity layers open. The fused tube is separated at predetermined points along its length to provide a series of filter rods.

An alternate method of forming filter rods is one which provides rods on a continuous basis. A narrow web or roll of filter material with width equal to that required for rolling a single fiter rod is imprinted with a thermoplastic pattern of fusible material. The printed web then passes through a spiral gathering horn which coils the sheet from one side to the other side. The rod is fused and the finished filter rods are cut off as they merge on a continuous basis.

With the above objectives, among others, in mind, reference is had to the attached drawings.

BRIEF DESCRIPTION OF THE DRAWINGS

In the drawings:

FIG. 8 is a plan view of an alternate embodiment of a filter rod of the invention in the unrolled condition with an arrow depicting the roll direction;

FIG. 9 is a schematic view thereof with the filter rod shown in the rolled condition and arrows depicting the flow path of smoke therethrough;

FIG. 10 is a plan view of a second alternate embodiment of the filter rod of the invention shown in the unrolled condition with an arrow depicting the roll direction;

FIG. 11 is a schematic view thereof showing the filter rod in rolled condition with arrows depicting the smoke path therethrough;

FIG. 12 is a plan view of a web of sheet material having a predetermined pattern of impervious material thereon for use in forming a plurality of filter rods of the invention with arrows depicting the roll direction and the direction of web travel;

FIG. 13 is a schematic view thereof; and FIG. 14 is an alternate arrangement of a sheet of web filter material containing a predetermined pattern of impervios material thereon for use in forming a plurality of filter rods in accordance with the invention with arrows showing an alternate arrangement of web travel direction with respect to roll direction.

DESCRIPTION OF THE PREFERRED EMBODIMENTS

FIG. 1—7 depict an embodiment of the coiled filter rod. In a particular environmental use, the filter rod 20 is shown mounted in a cigarette 21 in FIG. 1. The forward end portion of the cigarette contains tobacco 22 with the filter rod 20 in position adjacent to the tobacco 22 to receive the smoke. A wrapper 23 surrounds both the filter and the tobacco to form the completed cigarette.

Figure 3:
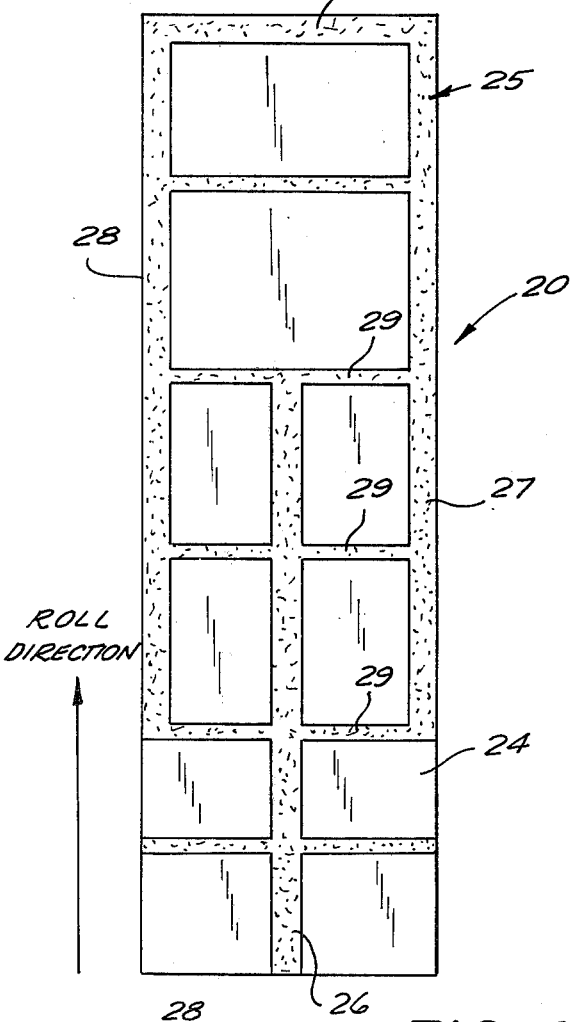
FIG. 3 is a plan view of an unrolled filter rod of the invention with the roll direction being shown by an arrow.
Figure 5:
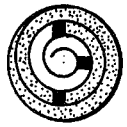
FIG. 5 is a sectional view thereof taken along the plane of line 5—5 of FIG. 4.
Figure 6:
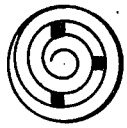
FIG. 6 is a sectional view thereof taken along the plane of line 6—6 of FIG. 4.
Figure 7:
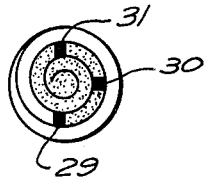
FIG. 7 is a sectional view thereof taken along the plane of line 7—7 of FIG. 4.

In FIG. 3, the filter rod 20 is shown in the unwound or unrolled position. A predetermined dimensioned web of sheet material 24 is cut in a rectangular configuration. The web material is of a porous and self-cohesive nature. In general, the sheet size in the direction of the roll to form the filter rod must be long enough to provide a tube having an external supporting surface of approximately 25 millimeters in circumference and an additional tube forming the internal filtering structure of less than 25 millimeter circumference and greater than approximately 4 millimeters in circumference. A common type of filter paper is utilized which will provide high efficiency in the filtering operation. Non-woven webs of cellulose acetate and other thermoplasitc webs have been found to operate satisfactorily as the filter medium 24.

A predetermined pattern of impervious material 25 is deposited on the web or sheet surface 24. The impervious material 25 may be deposited by imprinting the pattern on the web or by spraying or injecting the impervious material 25 onto the web surface 24. Material 25 may vary in thickness depending on the type of sheet surface 24 utilized. In general a range of 0.5 to 1.5 millimeter has been found to be satisfactory.

An acceptable material for impervious pattern 25 would be any material that would fuse and bond with the filter material 24. For example, polyethylene or a material known as "Parafilm" manufactured by the Marathon Corp. of Rothschild, Wis. and common sealing wax have been found to operate satisfactorily with a common grade filter paper. Material 25 should be of a nature which would provide impervious seals after the rolling is completed and the rod has been formed. If a temperature change is employed to fuse the impervious material 25, the material should be of the type which requires a softening and flow temperature which is below that which would undesirably affect the web filter material 24.

In the embodiment of FIG. 3, the pattern of impervious material is such that a central strip 26 is printed on the web 25 beginning at the leading roll edge of sheet 24 and extending in the roll direction for a distance which is somewhat longer than half the longitudinal length of sheet 24 but not the entire length. Additionally, a pair of peripheral strips 27 and 28 of impervious material are located on sheet 24 beginning at approximately one-third of the longitudinal length of sheet 24 and extending to the terminal end of the sheet 24 in the roll direction. Strips 27 and 28 are substantially parallel to central strip 26 and as shown overlap in the longitudinal direction with respect to sheet 24. As can be seen in FIG. 3, the combined lengths of strips 26 and 27 and also the combined lengths of strips 26 and 28 are longer than the longitudinal length of sheet 24, but less than twice its length. This is necessary for the strips to overlap. Consequently, when sheet 24 is spirally wound or rolled in the longitudinal direction as shown by the arrow, central strip 26 will be initially rolled to form a central disc 26 as shown in FIGS. 2 and 4 and peripheral strips 27 and 28 will be rolled subsequently to form peripheral annulets 27 and 28 as shown in FIGS. 2 and 4.

Furthermore, as shown in FIG. 3, three transverse strips 29 of impervious material are positioned on sheet 24 and form antispin bands 29 with each spin band connecting the strip forming disc 26 with the strips 27 and 28 which form annuli 27 and 28. Additionally, a sealing strip 30 of impervious material of positioned on the terminal edge of sheet 24 for assistance in the final sealing of the rod.

Figure 2:
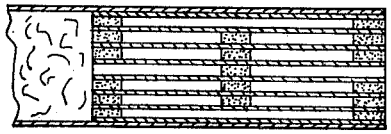
FIG. 2 is a fragmentary sectional elevation view thereof taken along the plane of line 2—2 of FIG. 1.
Figure 4:
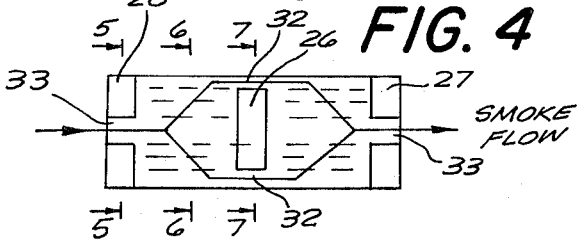
FIG. 4 is a schematic view of the filter rod of FIG. 3 in the rolled condition with arrows showing the path of travel of smoke therethrough.

After the sheet material 24 has been completely spirally wound into the configuration shown in FIGS. 2 and 4, the rod is subjected to a specific temperature to fuse the impervious material 25 so that impervious disc 26 is formed along with impervious annulets 27 and 28. Additionally, the impervious spin bands are fused so as to form longitudinal baffles as shown in particular in FIGS. 5–7. Sealing strip 30 is also fused to assist in holding the rod together. The antispin band 29 separates one cavity layer from another cavity layer and creates what is effectively a series of nestled porous tube-like structures. Disc 26 blocks one end of the inner axial cavity layers while leaving open the outer peripheral cavity layers 32 of the same end open. The annuli 27 and 28 leave the axial layers 33 open while blocking the peripheral layers 32.

In general, all of the filter designs are sealed rods of coiled sheet materials. The rods have internally positioned impervious discs and annuli of a fusible material which hold the rod together, space the coiled layers of sheet, and direct smoke flow across these layers. There should be at least one antispin band connecting a disc and an annulet. With a correctly chosen pattern of antispin bands interconnecting alternate discs and annuli imprinted on a single sheet of filter material, a multitube multipass filter is effectively made.

As shown in FIG. 4 by arrows, the smoke enters from one end of filter rod 20 through the open axial layers 33 while being blocked from the outer peripheral layers by annulet 28. Thereafter, the smoke is diffused through the internal filtering structure of spirally wound filter material with the assistance of antispin band 29. Thereafter, the smoke passes disc 26 through peripheral layers 32 while being blocked from the axial layers by the presence of disc 26. With the assistance of the antispin bands the smoke is diffused through the internal coiled layers of filtering structure and directed through the open axial cavities 33 at the terminal end of rod 20. The smoke is restricted from the peripheral cavities of the terminal end by the presence of annulet 27. In this manner, the smoke is efficiently filtered throughout the entire length of the rod 20 without any substantial pressure drop between one end of filter rod 20 and the other.

In general, the antispin band 29 forces the smoke to flow across the inner tube walls formed by the coiled rod. The bands are located such that there are no interconnecting cavities between the coiled layers of sheet in order to obtain the proper flow. There should be at least one annulet plug and one disc plug spaced apart from each other. If more plugs are provided, then the annuli should be alternated with the discs. Additionally, the internal diameter of the annuli should be smaller than or equal to the diameter of the discs. As discussed above, the material used in the printed areas provide impervious seals after the rod has been rolled into the final form and the printed material fused.

Two alternate arrangements of annuli and disc patterns are depicted in FIGS. 8 and 9 and in FIGS. 10 and 11. In the embodiment of FIGS. 8 and 9 in the roll direction a peripheral strip 35 forms the basis for disc 35 and a peripheral strip 36 on the opposing longitudinal edge of a sheet of web filter material 24a forms the basis for annulet 36. As can be seen in FIG. 8, to establish the appropriate overlap, the combined lengths of strips 35 and 36 are longer than the longitudinal length of web **24*a*, but shorter han twice its length. A first transverse strip 37 forms the basis for a first antispin band 37 and a second transverse strip 38 forms the basis for a second antispin band 38 when the rod is formed. Antispin bands 37 and 38 interconnect disc 35 with annulet 36. Transverse sealing strips 39 and 40 interengage to form a sealed rod when the sheet 24*a* is rolled in the direction shown by the arrow and the impervious material imprinted thereon is fused. Thereafter, when smoke passes through rod 20*a* as shown schematically in FIG. 9, disc 35 will block the inner axial passageways and leave the peripheral passageways 41 open for passage of the smoke. The antispin bands 37 and 38 will then assist in diffusing the smoke through the internal filtering structure until it passes through the axial cavities 42 at the opposite end of rod 20*a*. Annulet 36** blocks the peripheral passageways at the terminal end of the filter rod. In this manner, a high efficiency filter is provided with a minimum pressure drop.

Similarly, in the second alternative embodiment as shown in FIGS. 10 and 11 strip 43 on the periphery of sheet **24*b* adjacent the initial end of the sheet in the roll direction forms the basis of disc 43 when the rod is formed. Strip 44 on the opposing peripheral edge of sheet 24*b* forms the basis for an intermediate small annulet 44. A second peripheral strip 45 on the same edge as strip 43 but spaced therefrom forms the basis for a second large annulet 45. Once again the initial and terminal edges 46 and 47 respectively in the roll direction of sheet 24*b* contain impervious material to form the final seal for the rod when the rod is completely rolled and the imprinted material fused. A first transverse antispin band 48 interconnects disc 43 with small intermediate annulet 44 and a second parallel transverse antispin band 49 interconnects small annulet 44 with large annulet 45. Consequently, when rod 20*b* is rolled and fused the smoke path will be as shown schematically in FIG. 11. As shown, intermediate annulet 44 will permit smoke to pass through the axial cavities 50 and the extreme peripheral cavities 51. The fused annulet 44 does not permit any smoke to pass through the intermediate cavities at the initial end of the rod. Thereafter, with the assistance of the antispin bands 48 and 49 the smoke is diffused as shown through the internal filtering structure until it reaches the terminal end of the filter rod at which point it will pass from the rod through intermediate cavity layers 52. Large annulet 45 blocks the extreme outer peripheral cavities at the terminal end and disc 43 blocks the central axial cavity layers at the terminal end. In this manner, the smoke is directed through rod 20*b*** in an efficient manner with a minimum pressure drop.

Figure 1:
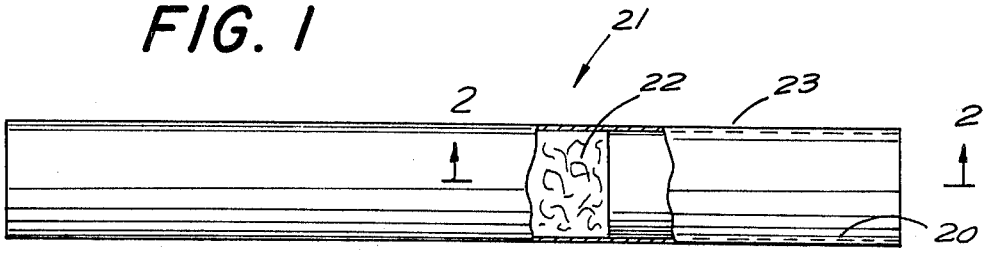
FIG. 1 is a partially sectional side elevation view of a cigarette containing a filter rod of the invention.

There are a number of related process variations for forming the coiled filter rod in regard to any of the embodiments discussed above. One variation is depicted in FIG. 12 and 13 of the drawings. As shown in FIG. 12, a repeating predetermined pattern of fusible material 53 is printed onto a continuous flat web filter material 54. The printed sheet 54 is cut in registry and rolled into a long tube 55 as shown in FIG. 13. In operation, as shown by the arrow the web on continous sheet material 54 travels in one direction and the cut sheet is rolled in the opposing direction. The tube 55 is thereafter constrained in shape as shown in FIG. 13 while the material 53 in the printed areas is fused together. The fused tube is then separated by cutting to give some predetermined number of filter rods 56. These rods 56 can then be made part of a cigarette assembly 21 as shown in FIG. 1 in an individual manner. As an example, in practical use the web filter sheet 54 would be of a predetermined width of ten centimeter multiples. The web would be initially cut along edge 57 and sheet 54 would be started to be rolled up in the direction opposing web travel as shown. Before completing the roll, the sheet 54 would be from the web by cutting along edge 58 and the final coil of wrapping would be completed. Thereafter, where the cut forming edge 58 is made on the web would form the new edge 57 for the next multiple rod tube. Sheet 54 would then be constrained in the formed tube configuration as shown in FIG. 13 and the printed areas would be fused and the individual rods 56 would be cut off at 100 millimeter lengths.

A variation on the process of forming the rods from a continuous web is shown in FIG. 14. As shown by the arrows, the roll direction is perpendicular to the web travel direction. As shown, a continuous pre-printed web strip 59 is fed into a filter maker in the direction shown for web travel by the arrow with a predetermined pattern of impervious material 60 thereon in repeating fashion. Strip 59, for example, could be approximately 50 to 80 millimeters wide. The strip 59 is rolled in the direction as shown by the arrow beginning at edge 61 and terminating at edge 62. The constrained tube at the completion of the rolling step is fused to form the predetermined arrangement of annuli, spin bands and discs and, thereafter, 100 millimeter filter rods may be cut off individually for use with individual cigarettes 21 as shown in FIG. 1.

A further variation on the forming process is similar to that shown in FIGS. 12 and 13 with the exception that the impervious material 53 deposited on sheet 54 and which serves to from the discs, annuli and antispin bands are either imprinted, sprayed, or injected onto the layers of sheet 54 as the tube 55 is being rolled into a coil.

Thus a variety of different embodiments of the filter have been discussed above along with a number of variations in the process for manufacturing the filter. Naturally other pattern arrangements falling within the scope of the invention can be readily visualized along with other related variations in the manufacturing process for forming the coiled filter while retaining the high efficiency low pressure drop smoke filtration advantages.

The following examples are representative of the process of forming the spirally wound filter and the resultant nature of the product.

EXAMPLE I

Eaton-Dikeman Grade 615 filter paper was cut into 30 × 70 millimeter strips. Common sealing wax was melted and brushed onto the paper strips according to FIG. 8. After the wax had hardened, the paper strip was rolled up to a 30 millimeter long tube of 25 millimeter circumference. The rolled tube was held in place and heated (110° C.) to fuse the wax pattern together. After cooling, the resulting tube was self-supporting and had a low (less than 1.5 inch w. g.) pressure drop.

EXAMPLE II

Eaton-Dikeman Grade 615 filter paper was cut into 30 × 80 millimeter strips and placed on a hot plate at greater than 130° C. Polyethylene film, 2–3 millimeter wide strips, was placed onto the paper according to FIG. 8. The polyethylene was allowed to melt slightly into the paper before rolling the paper into a tube as in Example I. The hot tube was held in place while cooling until the polyethylene has solidified holding the sheet layers about one millimeter apart.

EXAMPLE III

Eaton-Dikeman Grade 615 filter paper, 60 × 80 millimeters, strips were laid on a warm (70° C.) hot plate. Strips (2 millimeter wide and 1.5 millimeter thick of "Parafilm" manufactured by the Marathon Corp. of Rothschild, Wisconsin were placed on the paper according to the first 50 millimeters of FIG. 14. The "Parafilm" was allowed to soften and fuse to the paper. The warm paper was rolled into a 50 millimeter long tube of 25 millimeter circumference and then held until the "Parafilm" resolidified. The rigid tube was then cut into two 25 millimeter filters. Each filter had a 1.2 inch pressure drop and approximately 40% TPM efficiency.

EXAMPLE IV

A filter of the design shown in FIG. 8 and constructed from a Wiggins Teape standard filter paper has given satisfactory results. The filters were made in accordance with Example 3 above. Test filters which were 30 millimeters long were utilized but did not materially affect the results since a further test with 25 millimeter filters showed the same results. The test results are set out in the following table:

TABLE

| | | Filtration Results | | | | |
|---|---|---|---|---|---|---|
| Code | Filter | Filter P.D (inches w.g. | Efficiencies (%) Tar | Efficiencies (%) Nicotine | Performance* Index | Ratio Tar/ Nicotine |
| 1 | Multipass | 2.2 | 68 | 68 | 0.205 | 13.4 |
| 2 | Multipass | 2.5 | 75 | 74 | 0.214 | 13.0 |
| 3 | Multipass | 3.3 | 87 | 79 | 0.244 | 8.3 |
| 4 | Multipass (without antispin bands) | 0.9 | 17 | 18 | 0.084 | 13.6 |
| 5 | 30 mm 3.3Y44 Acetate | 3.4 | 56 | 49 | 0.096 | 11.4 |

$$* = \frac{-\ln\left(1 - \frac{E}{100}\right)}{PD\ (cm\ H_2O)}$$

Tar efficiencies are routinely used when computing performance indices. Computations are normally done in the metric system. The filter PD relationships of the above table are:

| Code | Filter P. D. Inches | Filter P. D. cm |
|---|---|---|
| 1 | 2.2 | 5.59 |
| 2 | 2.5 | 6.35 |
| 3 | 3.3 | 8.38 |
| 4 | 0.9 | 2.29 |
| 5 | 3.4 | 8.64 |

$$\text{Performance Index} = \frac{-\ln\left(1 - \frac{E}{100}\right)}{P.D.\ (cm\ H_2O)}$$

Where *ln* is the natural logarithm

E is the filter efficiency in percent

P. D. (cm $H_2O$) is the filter pressure drop in cm water gage. The designation P.D. represents pressure drop.

As evidenced by the results of the above table, the antispin bands block the spiral channel separating the layers of filter material, thus forcing the smoke through the walls. When these bands are omitted, the smoke channels down the filter and out. Thus, as shown by the code 4 sample in the above table, there is a large loss in filter efficiency.

Filter samples of codes 1 and 2 showed a lower performance index than did the filter sample of code 3. This was due to smoke leaking through the channels caused by poor fusion or sealing of the thermoplastic pattern to the filter material.

In summary, it is readily apparent from the above data that properly formed antispin bands are extremely effective in the filtering process without materially affecting the desired pressure drop conditions across a given filter rod.

Thus, the above discussed objectives of the invention, among others, are effectively attained.

I claim:

1. A sheet material adapted to be spirally wound into a filter rod comprising:

a sheet of porous, self-cohesive filter material;

a predetermined pattern of impervious material deposited on the sheet of porous filter material;

the impervious material being fusible and adapted to be bonded to the filter material;

the pattern of impervious material comprising a first strip running substantially longitudinally along the sheet from one end thereof and terminating short of the other end, a second strip spaced transversely apart from said first strip and running substantially longitudinally along the sheet and terminating short of the one end, and at least one antispin strip connecting said first and second strips such that when the sheet material is spirally wound longitudinally the strips form an annulet plug connected by a continuous antispin band to a disc plug, the outer diameter of the disc being at least as great as the inner diameter of the annulet.

2. The sheet of claim 1, including a third strip which runs along one edge of the sheet from said one end thereof and terminates short of the other end, wherein the first strip runs along the other edge of the sheet, the second strip is positioned intermediate the first and third strips, and a plurality of antispin strips connecting said second strip to said first and third strips.

3. The sheet of claim 2 wherein the respective combined lengths of the first and second strips and the third and second strips are longer than the longitudinal length of the sheet and less than twice the length.

4. The sheet of claim 1 wherein the first strip extends along one edge of the sheet and the second strip extends from the other end of the sheet along the other edge thereof.

5. The sheet of claim 4 wherein the combined lengths of said first and second strips are longer than the longitudinal length of said sheet and less than twice the length.

6. The sheet of claim 1 wherein the first strip extends along one edge of the sheet and the second strip extends along the other edge of the sheet, said pattern further including a third strip extending from the other end of said sheet along the one edge thereof, said second strip having one end connected to said first strip by one antispin strip and having its other end connected to said third strip by another antispin strip.

* * * * *